United States Patent [19]

Ferguson

[11] 4,263,687

[45] Apr. 28, 1981

[54] BOOK NIPPING APPARATUS

[75] Inventor: Ronald J. Ferguson, Cincinnati, Ohio

[73] Assignee: Crawley Book Machinery Company, Newport, Ky.

[21] Appl. No.: 19,282

[22] Filed: Mar. 12, 1979

[51] Int. Cl.[3] ..... B42C 13/00

[52] U.S. Cl. ..... 11/3; 100/295

[58] Field of Search ..... 11/1 R, 1 B, 1 CP, 2, 11/3, 4, 5; 100/295

[56] References Cited

U.S. PATENT DOCUMENTS

| | | | |
|---|---|---|---|
| 2,644,965 | 7/1953 | Kitcat | 11/1 B |
| 2,695,907 | 11/1953 | Kramer | 11/1 B |
| 3,731,617 | 5/1973 | Hall | 1/1 B X |

*Primary Examiner*—Paul A. Bell

*Attorney, Agent, or Firm*—Wood, Herron & Evans

[57] ABSTRACT

Book nipping apparatus having first and second pairs of jaws adapted to apply nipping pressure on a stack of signatures. The first pair of jaws is structured to press the signature stack together adjacent the signatures' back or spine edge in a straight spine edge configuration, and the second pair of jaws is structured to press the signature stack together adjacent the signatures' front edge in a curved, or deformed, front edge configuration. The first and second jaw apparatus functions to prevent the center signatures in the stack from tending to slide or squirt out of book alignment with the outside signatures in the stack when the entire stack is exposed to the full nipping pressure.

20 Claims, 4 Drawing Figures

BOOK NIPPING APPARATUS

This invention relates to book binding machinery. More particularly, this invention relates to an improved nipping apparatus for book binding machinery.

In the binding of books, and particularly in connection with the binding of thicker volumes intended to have permanence, e.g., law books and the like, the book's signatures are subjected to a nipping step prior to being encased with hard covers. In the nipping step, and in accord with the prior art, the book's individual signatures have been sewn together into a stack or book configuration. The signature stack's back or spine edge is then positioned against a bed plate for orienting the spine edges of the stack's signatures in a common plane. Subsequently, significant pressure is applied to the outside faces of the signature stack by closing a pair of jaws against opposite faces of the stack, one jaw against one face of the signature stack generally being stationary, and the other jaw being movable into and out of pressure engagement with the other face of the signature stack. This nipping step compresses air out of the signature stack for the purpose of forcibly reducing the thickness of the signature stack into a thickness more proximate to the final book thickness, and for providing the prospective book in a more compact and even form. In other words, the nipping step functions to establish a more uniform final book thickness for the sewn together signatures prior to covering of the book. This makes the sewn together stack of signatures, i.e., the prospective book, easier to handle and stack, and protects the individual pages from damage, during subsequent binding and covering steps.

With nipping apparatus known to the prior art, however, a problem arises with books of substantial thickness, i.e., with relatively thick stacks of signatures, when these signature stacks are exposed to the nipping pressure. The problem that occurs is that the middle or center signatures of a stack, i.e., the signatures generally centrally located between the side faces of the signature stack, tend to slide or squirt outwardly relative to those side faces upon exposure to the nipping pressure between a single pair of jaws to provide a concave surface edge along the spine edge of the signature stack, and a corresponding convex surface edge along the front edge of the signature stack, after the stack has been exposed to the nipping pressure. This problem occurs because the signatures' spine edges are positioned against the apparatus' bed plate, but are not prevented against outward movement along the book's front edge, so that when pressure is exerted against the opposing side faces of the prospective book the centered or middle signatures tend to squirt or slide outwardly over the outside signatures of the stack.

It has been the primary objective of this invention to provide improved book nipping apparatus in which a stack of signatures, upon being exposed to nipping pressure on opposite side faces of the stack, presses the back or spine edge of the stack into straight spine edge configuration, but which presses the front edge of the stack into a curved or deformed configuration, for preventing the stack's center signatures from tending to slide or squirt out of book alignment with the stack's outside signature.

It has been another objective of this invention to provide improved book nipping apparatus comprising a first movable jaw for applying a nipping pressure along a signature stack's spine edge, and a second movable jaw for applying a nipping pressure adjacent a signature stack's front edge, at least one of the jaws being structured for independent movement relative to the other of the jaws in a manner that, during use, prevents substantial sliding movement of the centered or middle signatures of the stack relative to the outside signatures of the stack during exposure of the stack to the nipping pressure of both jaws.

It has been a further objective of this invention to provide improved book nipping apparatus comprising first and second pairs of jaws, the first pair of jaws being structured to compress or nip a signature stack along the back or spine edge in a straight spine edge configuration, and the second pair of jaws being structured to compress or nip a signature stack along the front edge thereof in a deformed or curvilinear front edge configuration, the cooperative interaction of the jaws preventing the centered or middle signatures of the signature stack from substantial sliding movement relative to the outside signatures of the stack during exposure of the stack to nipping pressure.

Other objectives and advantages of the invention will be more apparent from the following detailed description taken in conjunction with the drawings in which.

Figure 2:
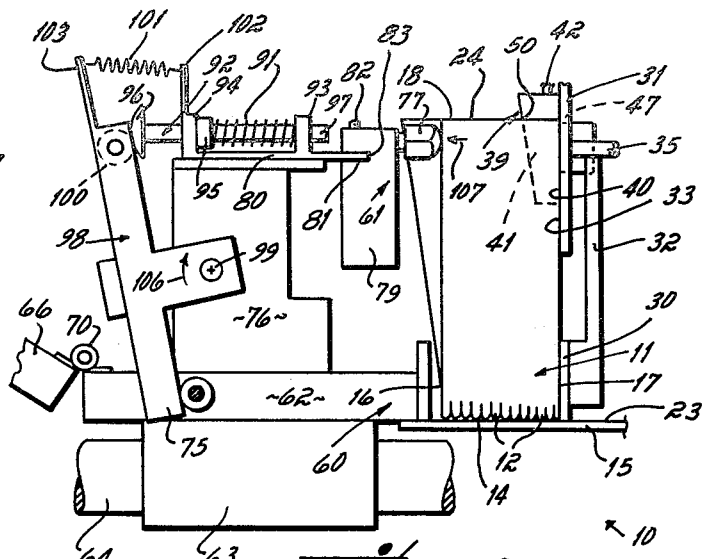
FIG. 2 is a view similar to FIG. 1 but showing the movable upper and lower jaws in an intermediate nipping pressure position.
Figure 1:
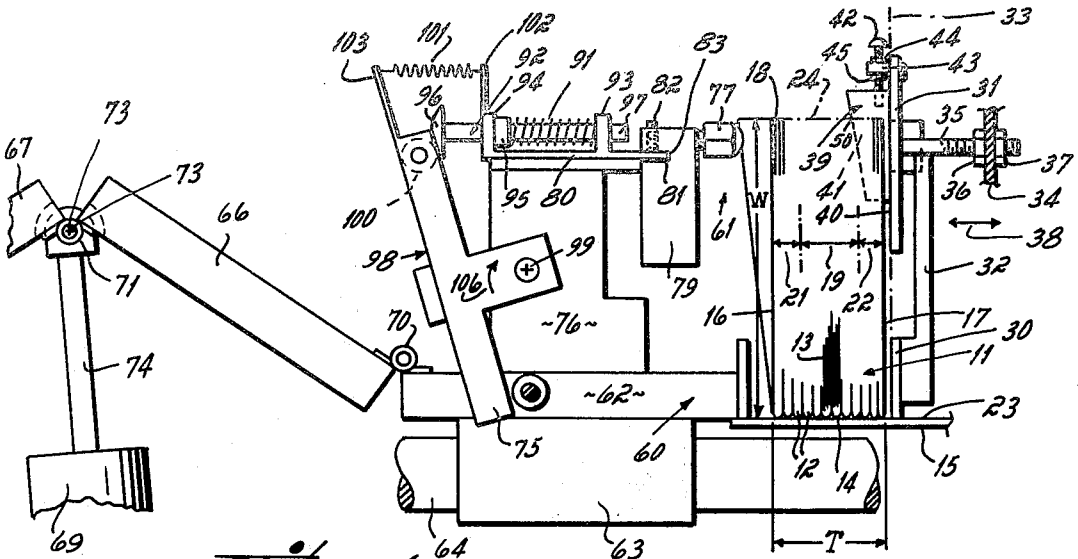
FIG. 1 is a side view illustrating book nipping apparatus in accord with the principles of this invention, the apparatus' upper and lower jaws being withdrawn into the storage or relaxed position, and with a stack of signatures disposed between the jaws of each pair.
Figure 3:
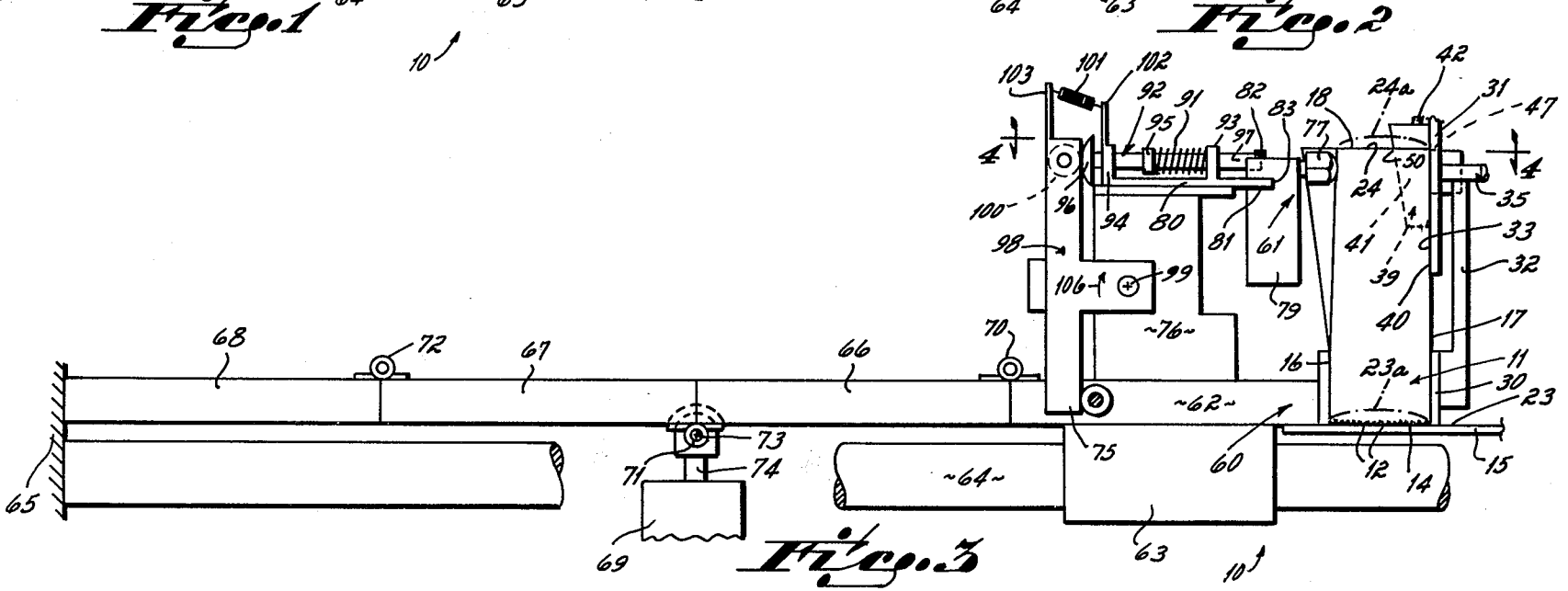
FIG. 3 is a view similar to FIGS. 1 and 2 but illustrating the movable upper and lower jaws in a final nipping pressure position.

The improved book nipping apparatus 10 of this invention, as illustrated in FIGS. 1–3, is adapted to apply nipping pressure to a stack 11 of signatures 12, the signatures (each of which is comprised of a series of pages 13) having previously been sewn together in book configuration. The stack 11 of signatures 12 includes a back or spine edge 14 supported on the apparatus' immobile bed plate 15, opposed side faces 16, 17 of the stack, and a front edge 18. The signature stack 11 also includes, generally speaking, a series of centered or middle signatures 19, and opposed series of outside signatures 21, 22. The set-up or no pressure position of the signature stack 11 on the bed 15 of nipping apparatus 10 is illustrated in FIG. 1. Note, as shown in this FIG. 1, that the stack's spine edge 14 is fully seated or flush against the bed plate 15 from one side face 16 to the other side face 17 of the stack in spine edge plane 23, and that the stack's front edge 18 is in front edge plane 24 generally parallel to spine edge plane 23. The signature stack's pressure position is shown in FIG. 3. Note also in this FIG. 3 pressure position that the stack's spine edge 14 lies flush against bed plate 15 from one side face 16 to the other side face 17 in plane 23, and that the stack's front edge 18 remains in plane 24 parallel to the stack's spine edge plane 23. Without the improved apparatus 10 of this invention, and upon exposing the signature stack 11 shown in FIG. 1 to a pressure position shown in FIG. 3, it would be expected that the center or middle signature group 19 of the stack 11 would tend to squirt or slide vertically upward (as shown in the figures) until the stack's spine edge plane and the stack's front edge plane assume a humped phantom line position 23a, 24a shown in FIG. 3. In other words, and in book nipping apparatus of the prior art, with thicker signature stacks 11 it is not uncommon for the stack's back or spine edge 14 to assume a concave attitude 23a and the stack's front edge 14 to assume a convex attitude 24a, as illustrated in the phantom lines shown in FIG. 3, upon being exposed to nipping pressures. It is toward overcoming the humping 23a, 24a problem that the apparatus 10 of this invention is directed.

Figure 4:
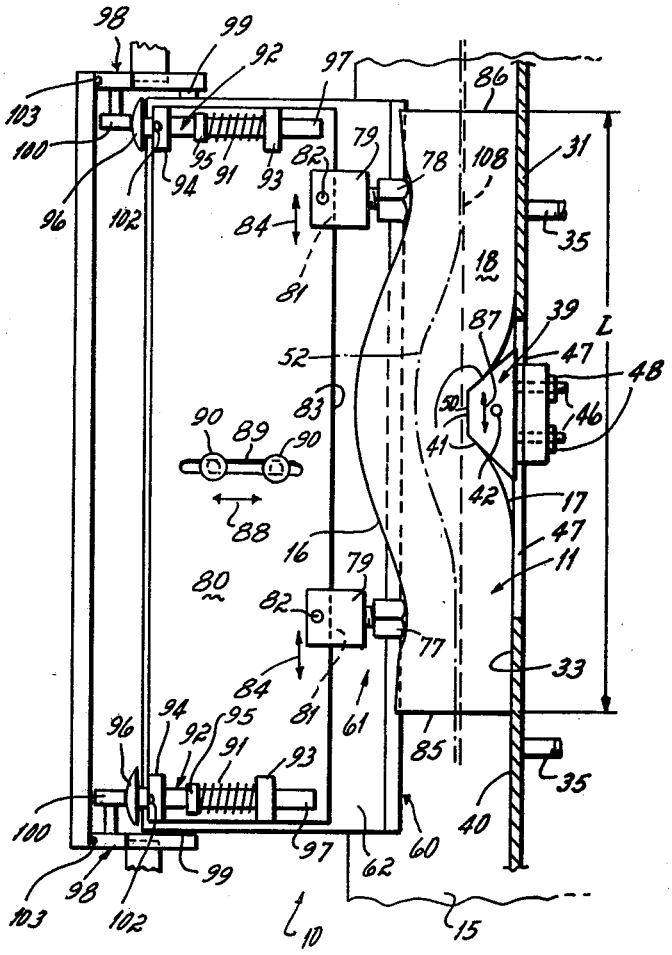
FIG. 4 is a cross-sectional view taken along line 4—4 of FIG. 3.

The book nipping apparatus 10 includes a first or lower stationary jaw 30 and a second or upper stationary jaw 31 associated with the machine's bed plate. The lower 30 and upper 31 jaws are in the nature of planar back-up plates oriented normal to the machine's bed plate 15, the two jaws being connected one to another by arm 32 so that same are fixedly held in planar alignment in back-up or stationary force plane 33. The stationary jaws 30, 31 are connected to the apparatus' stationary frame 34 through threaded studs 35. The threaded studs 35, which are at one end to the upper jaw 31 as shown in FIG. 4, are received through bores in the stationary frame 34 at the other end, and are held in immobile fashion by adjustment units 36, 37 on either side of that frame, thereby fixing lower 30 and upper 31 stationary jaws in position relative to the bed plate 15. The stationary jaws 30, 31 are adjustable in a direction 38 perpendicular to the stack's pages 13 through use of adjustment nuts 36, 37, and are so positioned depending on the thickness of the signature stacks 11 to be processed through the apparatus 10.

The upper stationary jaw 31 carries a forming anvil 39 on the front or book face 40 thereof, and positioned between the ends thereof. The forming anvil 39 presents a forming face 41 of generally inverted partial concial configuration relative to the bed plate 15, the forming face 41 of the forming anvil 39 presenting, in effect, a hump or convex irregularity on the planar book face 40 of the upper jaw 31. The forming anvil 39 is vertically adjustable relative to the upper jaw 31, and is also horizontally adjustable relative to the upper jaw 31, thereby making the anvil 39 likewise vertically and horizontally adjustable relative to bed plate 15. The vertical adjustment is achieved through use of adjusting bolt 42 threaded into the anvil 39 at one end, the bolt 42 (and, hence, the anvil 39) being held in desired vertical position relative to collar 43 by adjustment nuts 44, 45. The vertical position of the collar 43 is fixed in immobile position on the stationary plate 31 and is adjustable horizontally (by means not shown) to maintain vertical alignment with the anvil 39. The forming anvil 39 is also adjustable horizontally relative to the upper jaw 31. This horizontal adjustment is achieved through use of studs 46 mounted on the forming anvil 39 that pass through a horizontal slot 47 in the stationary upper jaw 31, compare FIGS. 1 and 4. Adjustment nuts 48 are threaded onto the studs for holding the forming anvil 39 in the desired position against the back-up plate 31. The vertical and horizontal position of the forming anvil 39 is dependent on the width W and length L of the signature stacks 11 being processed. Also, the vertical position of the forming anvil 39, i.e., the intersection 50 of the signature stack's front edge plane 24 with the forming face 41 presented by the forming anvil 39, is important in establishing the deformed or curved front edge configuration (denoted by phantom line 52) of the stack's front edge 18 when the signature stack 11 is in the pressure position, see FIGS. 3 and 4.

The book nipping apparatus 10 also includes lower 60 and upper 61 movable jaws which are both mounted to sliding pressure block 62. The sliding pressure block 62 is adapted to move between a no pressure or relaxed position shown in FIG. 1 and a full pressure position shown in FIGS. 3 and 4. This sliding pressure block 62 includes the lower jaw 60 fixed directly thereto. The movable lower jaw 60 is in the nature of a planar plate aligned parallel to, and generally the same height as, the stationary lower jaw or back up plate 30 with which it cooperates. The sliding pressure block 62 is fixed to a guide block 63 received on guide rod 64, the guide rod being fixed to the machine's stationary frame 65. The sliding pressure block 62 is also connected by accordian force plates 66–68 with the machine's frame 65 and with a pressure motor 69. The foldable accordian force plates 66–68 are hinged together one to the other at 70–72 as shown in FIGS. 1–3, and the pressure motor 69 is connected at a pivot connection 73 to the hinge 71 between force plates 66 and 67. The pressure motor 69, which may be a pneumatic or hydraulic motor, causes the force plates 66–68 to accordian fold into a FIG. 1 no pressure or relax position when the motor's piston rod 74 is extended so as to withdraw movable jaws 60, 61 from nipping pressure contact with the signatures 12, and causes the force plates 66–68 to extend into planar alignment in a FIG. 3 pressure position when the motor's piston rod 74 is retracted so as to extend the movable jaws 60, 61 into nipping pressure contact with the signature stack 11. As noted, the sliding pressure block 62 is guided in this linear reciprocating motion by guide block 63 on guide rod 64.

The movable upper jaw 61 of the improved book nipping apparatus 10 is mounted on a support block 76 which is immobily fixed on the sliding pressure block 62, thereby moving the upper jaw into and out of nipping pressure relation with the side face 16 of the signature stack 11 as the lower movable jaw 60 is so moved. The upper movable jaw 61 is comprised of two separate pressure knobs 77, 78 disposed laterally on either side of the opposing forming anvil 39, see FIG. 4. These pressure knobs 77, 78 are each fixed to a mount block 79 that is slidably carried on a carrier in the form of plunger plate 80. Each mount block 79 is provided with a slot 81 therethrough, and a set screw 82 by which the desired lateral position of each pressure knob 77, 78 can be located along the face edge 83 of that plunger plate as shown in FIG. 4. Thus, and in use, the pressure knobs 77, 78 can be laterally adjusted in direction 84 (which is parallel to the stack's pages 13) between end edges 85, 86 of the signature 12 as desired by the machine's operator. The lateral adjustment path 84 of the movable pressure knobs 77, 78 in combination with the lateral adjustment path 87 of the opposed forming anvil 39, allows the forming anvil and the pressure knobs to be located between the signature stack's end edges 85, 86 in those locations which provide the machine's operator with the desired curvalinear or deforming center line 52 desired for the book's top edge 18 upon application of nipping pressure to the signature stack 11. In other words, the vertical and horizontal adjustability of the forming anvil 39, and the horizontal adjustability of the pressure knobs, 77, 78, on opposed side faces 16, 17 of the signatures 13, cooperate to define the curvalinear bend center line 52 of the signature stack's top edge 14 when the nipping pressure is applied as shown in FIGS. 3 and 4.

The movable upper jaw's plunger plate 80 is slidably mounted to the movable upper jaw's support block 76 for sliding motion on path 88 oriented perpendicular to pages 13 of the signature stack 11. The slidable connection is established by centered slot 89 in the plunger plate oriented normal to the stationary jaw's back up plates 30, 31 as shown in FIG. 4, alignment pins 90 being fixed to the support block to maintain the sliding alignment between the plunger plate 80 and the support block 76. The plunger plate 80, at each end edge thereof, carries a spring 91 loaded plunger 92, see FIGS. 1 and 4. The plunger 92 is received in front 93 and rear 94 brackets mounted to the plunger plate 80, and each plunger 92 includes a collar 95 disposed between the head 96 and foot 97 ends thereof. The compression spring 91 is interposed between collar 95 and front bracket 93 for each of the plungers 92. The plungers 92 each cooperate with linkage in the form of a separate rocker arm 98 pivotally mounted to the support block 76 on pivot axis 99. Each rocker arm 98 mounts a roller 100 adjacent the top end thereof for contact with the associated plunger's head 96. Each rocker arm 98 is biased continually in the clockwise direction by tension spring 101 connected at one end to post 102 fixed to the plunger plate 80, and at the other end to post 103 fixed to the rocker arm, which spring 101 continually biases the rocker arm's roller 100 into contact with the plunger's head 96. The tension force of each tension spring 101 is substantially less than the compression force of each associated compression spring 91. That end of each rocker arm 98 on the other side of the arm's pivot axis 99 is adapted to cooperate with actuator stud 104 fixed to the machine's frame, i.e., with immobile actuator stud 104. Thus, the upper movable jaw 61 is spring 91 biased, and is movable relative to the lower movable jaw 60 through use of the rocker arm 98/plunger 92 mounting assembly, i.e., a limited pressure or resilient mounting assembly, as explained in further detail below.

In use of the book nipping apparatus, the lower 60 and upper 61 movable jaws are retracted into the no pressure or relaxed position illustrated in FIG. 1. This position is established by retracting sliding pressure block 62 away from the stationary jaws 30, 31, the pressure motor 69 being actuated to extend piston rod 74 for folding the force plates 66–68 about hinge lines 70–72 in accordian fashion. This retracts not only the lower jaw 60 (since it is directly mounted on the sliding pressure block 62), but also both upper jaw knobs 77, 78 (since they are also mounted, through the plunger plate 80 and support block 76, to the sliding pressure block 62). In this retracted or relaxed position of the movable jaws 60, 61, a sewn together stack 11 or book of signatures 12 is interposed between the movable 60, 61 and stationary 30, 31 jaws. The signature stack 11 is so positioned that its spine edge 14 rests flush on the machine's bed plate 15 as shown in FIG. 1. The forming anvil 39 is horizontally positioned midway between end edges 85, 86 of the signature stack 11 through use of lateral adjustment structure 46, 48. Further, the forming anvil 39 is vertically positioned, by use of vertical adjustment structure 42–45, such as to provide the desired curvalinear or deformed configuration 52 for the front edge 14 of the stack 11 when in the pressure position shown in FIGS. 3 and 4. Further, the movable upper jaws 77, 78 are moved laterally by adjustment apparatus 79, 82 so as to position same where desired relative to the end edges 85, 86 of the book, those jaws 77, 78 normally being positioned equidistantly from the book's end edges relative to the forming anvil 39. The adjustment position of the forming anvil 39 and the upper movable pressure jaws 77, 78 is primarily dependent on the length L of the signature stacks 11 to be processed, and on the curvalinear or deformed shape 52 desired for the front edge 18 of the stack 11 in the pressure position to achieve the objective of maintaining the stack's front edge plane 24 and spine edge plane 23 parallel to the bed plate 15 in that pressure position. The stationary jaws 30, 31 are also adjustable depending on the thickness T of the signature stacks 11 to be processed. This letter stack thickness adjustment is accommodated by use of adjustment structure 35–37 for moving the stationary jaws 30, 31 relative to the immobile frame 34, and thereafter fixing same in final use position.

With the forming anvil 39, stationary jaws 30, 31 and movable upper jaw 77, 78 positioned as desired, a stack 11 of signatures is introduced between the jaw pairs 30, 31 and 60, 61 when the improved book nipping apparatus is in the no pressure or relaxed position shown in FIG. 1. Subsequently, the sliding pressure block 62 is moved toward the stationary jaws 30, 31 through use of pressure motor 69 by drawing the force plates 66–68 from the folded position shown in FIG. 1 toward the planar position shown in FIG. 3. As the force plates move from the FIG. 1 position toward the FIG. 3 position, and as shown in FIG. 2, the movable upper jaws 77, 78 are the first of the movable lower 30 and upper 31 jaws to contact the outside face 16 of the signature stack 11. In other words, and with the stack's outside face 17 flush against stationary jaws 30, 31 the movable upper jaw knobs 77, 78 are caused to move toward the stack relative to the movable lower jaw plate 60 as the sliding pressure plate 62 is moved toward the stack by pressure motor 69 and force plates 66–68. This forward motion of the upper jaws 77, 78 relative to the lower jaw 60 is introduced because actuator pins 104 fixed to the machine frame (not shown) engages foot ends 75 of the rocker arms 98 while the sliding pressure block 62 continues to move toward the stationary jaws 30, 31. This causes the rocker arms 98 to pivot clockwise as shown by phantom arrow 106 in FIG. 2, thereby causing the plungers 92, plunger plate 80 and movable upper jaw knobs 77, 78 to move forwardly toward the stationary jaws 30, 31 against the retract bias of tension springs 101. The plungers 92, plunger plate 80 and upper jaw knobs 77, 78 extend or move together as a unit relative to support block 76 (and, hence, relative to lower jaw 60) at this time because the resistive force (see phantom arrow 107) exerted by the signature stack 11 is not sufficient to overcome the compression force exerted by the upper jaw assembly's compression springs 91. In this intermediate position shown in FIG. 2, the upper jaw knobs 77, 78 function to push the upper edge 18 of the signature stack 11 into that alignment position illustrated relative to the initial alignment position shown in FIG. 1. And in this intermediate alignment position, therefore, a preliminary degree of nipping pressure is exerted against the upper edge 18 of the signature stack 11 before any nipping pressure is exerted against the spine edge 14 of the signature stacks.

As the sliding pressure block 62 is further moved toward the stationary jaws 30, 31 into the final or pressure position shown in FIG. 3 from the intermediate position shown in FIG. 2, the lower movable jaw 60 contacts the face 16 of the signature stack 11 adjacent the book's back or spine edge 14, and cooperates with the opposed stationary lower jaw 30 to pressure that spine edge into a generally linear configuration as illustrated by center line 108 in FIG. 4 (i.e., a configuration or position parallel to the pages 13 of the stack 11) because the lower movable jaw 60 and lower stationary jaw 30 are planar and parallel relative one to another. Also as the pressure block 62 slides from the FIG. 2 intermediate position toward the FIG. 3 nipping pressure or extended position, the immobile actuator pins 104 cause the plunger's rocker arm 98 to pivot further clockwise into a final position shown in FIG. 3, but at this final pressure position of the rocker arms 98 the resistive forces 107 exerted on the movable upper jaw knobs 77, 78 by the stack's top edge 18 overcomes the compression strength of the compression springs 91, thereby causing the plungers 92 to move relative to the plunger plate 80 as shown in FIGS. 3 and 4. This relative movement of the plungers 92 relative to the plunger plate 80 results in a force exerted by the movable upper jaw 61 against the face 16 of the signature stack 11 which is substantially equal to the compression force strength of the springs 91, the springs 91 thereby determining the nipping pressure of the upper jaw 61 against the signatures 12. This over-travel plunger mechanism 91, 92, 80, i.e., this limited pressure or resilient mounting assembly, insures that the pages 13 of the signatures 12 adjacent the upper edge 18 thereof will not be unduly stretched out of shape due to the deforming of the stack's upper edge 18 into the curvalinear pattern 52 shown in FIG. 4. Further, and because the final nipping pressure established between the movable spring 91 loaded upper jaw 61 and stationary upper jaw 31 is achieved before the final nipping pressure established between the movable lower jaw 60 and stationary lower jaw 30 is achieved, i.e., because the nipping pressure is always greater between upper jaws 61, 31 than between lower jaws 60, 30 until spring 91 pressure is overcome, as the movable jaws 60, 61 move from the FIG. 2 to the FIG. 3 position, the centered signatures 19 are prevented from sliding upwardly or downwardly, relative to the outside signatures 21, 22 in the stack 11. This for the reasons that the stack's upper edge 18 is distorted into curvalinear configuration 52, and the pressure between upper jaws 61, 31 (relative to later nipping pressure between lower jaws 60, 30 in the relax to full pressure sequence prevents upward movement of the centered signatures 19, and the bed plate 15 prevents downward movement of those centered signatures.

As the nipping pressure is released, the operation sequence of the movable jaws 60, 61 is reversed from FIG. 3 to FIG. 1. In this regard, the lower movable jaw 60 is the first to be completely withdrawn from nipping pressure relation with the signature stack as shown in FIG. 2. As the movable jaw 60, 61 mechanism reverts from the FIG. 3 to the FIG. 2 attitude, the compression springs 91 associated with plungers 92 force the plungers back into the FIG. 2 position, thereby retaining the upper movable jaw knobs 77, 78 in a declining pressure relation with the stack's upper edge 18 until the lower jaw 60 is fully released. This reverse operational sequence prevents the centered signatures 19 from sliding or squirting upwardly into the convex 23*a*/concave 24*a* configuration shown in phantom lines in FIG. 3 as the nipping pressure is released from the stack 11.

Having described in detail the preferred embodiment of my invention, what I desire to claim and protect by Letters Patent is:

1. Book nipping apparatus for applying nipping pressure to a stack of signatures, said signature stack having a spine edge, and said signature stack having a front edge parallel to and opposite from said spine edge, said apparatus comprising a first pair of jaws structured to compress a signature stack along the spine edge thereof into a linear spine edge configuration, all spine edges of all signatures in said stack being retained in said linear configuration while under compression from said first jaw pair, and a second pair of jaws structured to compress said signature stack along the front edge thereof into a non-linear front edge configuration, all front edges of all signatures in said stack being retained in said non-linear configuration while under compression from said second jaw pair, the non-linear front edge configuration relative to the linear spine edge configuration, as provided by the cooperative inter-action of said first and second jaw pairs, preventing the middle signatures of said signature stack from substantial sliding movement relative to the outside signatures of said signature stack during exposure of said stack to nipping pressure by said jaws.

2. Book nipping apparatus as set forth in claim 1, at least one of each of said first and second jaw pairs being movable relative to the other of each of said first and second jaw pairs, and apparatus further comprising a pressure motor connected with said movable first and second jaws, said pressure motor being operable to extend said jaws into and retract said jaws from the nipping pressure position with said stack.

3. Book nipping apparatus as set forth in claim 2, said apparatus further comprising a sliding pressure block, said pressure block being connected with said pressure motor, both of said movable jaws also being connected to said pressure block.

4. Book nipping apparatus as set forth in claim 1, said apparatus further comprising a limited pressure assembly connected with said second pair of jaws, said limited pressure assembly normally resiliently biasing at least one jaw of said second jaw pair toward a relaxed position when said stack is not exposed to nipping pressure by said second jaw pair, said limited pressure assembly causing said one jaw to expose said stack's front edge to a force generally no greater than the force of said normally resilient bias upon exposure of said one jaw to a resistive force from said stack's front edge greater than the force of said normally resilient bias of said assembly during exposure of said stack to nipping pressure.

5. Book nipping apparatus as set forth in claim 4, said limited pressure assembly comprising a spring connecting said one jaw of said second jaw pair with a sliding pressure block, said jaw being movable relative to said sliding pressure block, said spring providing said normally resilient bias to said one jaw.

6. Book nipping apparatus as set forth in claim 5, said limited pressure assembly further comprising an actuator arm adapted to move said one jaw of said second jaw pair independently relative to the jaws of said first jaw pair, said actuator arm being activated in response to movement of said sliding pressure block relative to the frame of said apparatus.

7. Book nipping apparatus as set forth in claim 1,
one jaw of said second jaw pair further comprising a stationary anvil located to engage one side face of said stack, and
the other jaw of said second jaw pair comprising at least two spaced force surfaces located to engage the other side face of said stack, each of said force surfaces being located between said anvil and an end edge of said stack relative to the length of said stack, said anvil and said force surface cooperative to deform the front edge of said stack into a generally curvilinear configuration upon exposure of said stack to nipping pressure by said jaws.

8. Book nipping apparatus as set forth in claim 7, said apparatus further comprising
anvil adjustment structure connected with said one jaw of said second jaw pair for adjusting the position of said anvil relative to the centerline of the spine edge, and
force surface adjustment structure connected with said other jaw of said second jaw pair for adjusting the position of said force surfaces relative to the length of said signature stack.

9. Book nipping apparatus as set forth in claim 7, said apparatus further comprising
stack thickness adjustment structure connected with said first and second jaw pairs for adjusting the minimum distance between jaws of each pair when said jaws are in the nipping pressure position.

10. Book nipping apparatus as set forth in claim 7, said apparatus further comprising
a bed plate adapted to receive a signature stack in supportive relation on the spine edge thereof.

11. Book nipping apparatus for applying nipping pressure to a stack of signatures, said apparatus comprising
a first movable jaw for applying the nipping pressure along said stack's spine edge,
a second movable jaw for applying the nipping pressure along said stack's front edge, said second movable jaw being structured for independent movement relative to said first movable jaw as said jaws are moved between a retracted position out of contact with said stack and an extended position at which said stack is exposed to the nipping pressure,
a support surface relative to which each of said first and second jaws is movable, said support surface cooperating with said jaws to establish the nipping pressure on said stack in the extended position of said jaws, and
linkage connecting said first and second movable jaws, said linkage being structured to extend said second jaw relative to said first jaw as said jaws are moved from said retracted position to said extended position.

12. Book nipping apparatus as set forth in claim 11, said apparatus further comprising
a pressure motor connected with said movable first and second jaws, said pressure motor being operable to extend said jaws into and retract said jaws from the nipping pressure position with said stack.

13. Book nipping apparatus as set forth in claim 12, said apparatus further comprising
a sliding pressure block, said pressure block being connected with said pressure motor, both of said movable jaws also being connected to said pressure block.

14. Book nipping apparatus as set forth in claim 11, said apparatus further comprising
a limited pressure assembly connected with said second jaw, said limited pressure assembly normally resiliently biasing said second jaw toward a relaxed position when said stack is not exposed to nipping pressure by said second jaw, said limited pressure assembly causing said second jaw to expose said stack's front edge to a force no greater than the force of said normally resilient bias during exposure of said stack to nipping pressure, thereby preventing potential damage to the front edge of said signature stack.

15. Book nipping apparatus as set forth in claim 14, said limited pressure assembly comprising
a spring connecting said second jaw to a carrier, said carrier, spring and second jaw being movable relative to said first jaw, said spring providing said normally resilient bias to said second jaw, and said linkage means being operably connected with said carrier and said first jaw.

16. Book nipping apparatus as set forth in claim 14, said linkage comprising
an actuator arm adapted to move said second jaw independently relative to said first jaw, said actuator arm being activated in response to movement of said first jaw relative to the frame of said apparatus.

17. Book nipping apparatus as set forth in claim 16, said apparatus further comprising
a first pair of jaws structured to compress a signature stack along the spine edge thereof in a generally straight spine edge configuration, and
a second pair of jaws structured to compress said signature stack along the front edge thereof in a non-linear configuration,
one jaw of said second jaw pair further comprising a stationary anvil located to engage one side face of said stack, and
the other upper jaw of said second jaw pair comprising at least two spaced force surfaces located to engage the other side face of said stack, each of said force surfaces being located between said anvil and an end edge of said stack relative to the length of said stack, said anvil and said force surfaces cooperating to deform the front edge of said stack into a generally curvalinear configuration upon exposure of said stack to nipping pressure.

18. Book nipping apparatus as set forth in claim 17, said apparatus further comprising
anvil adjustment structure connected with said anvil for adjusting the position of said anvil relative to the width of said signature stack, and
force surface adjustment structure connected with said other upper jaw for adjusting the position of said force surfaces relative to the length of said signature stack.

19. Book nipping apparatus as set forth in claim 17, said apparatus further comprising
stack thickness adjustment structure connected with said first and second jaw pairs for adjusting the minimum distance between jaws of each pair when said jaws are in the nipping pressure position.

20. Book nipping apparatus as set forth in claim 17, said apparatus further comprising
a bed plate adapted to receive a signature stack in supportive relation on the spine edge thereof.

* * * * *

UNITED STATES PATENT AND TRADEMARK OFFICE

CERTIFICATE OF CORRECTION

PATENT NO. : 4,263,687

DATED : April 28, 1981

INVENTOR(S) : Ronald J. Ferguson

It is certified that error appears in the above—identified patent and that said Letters Patent is hereby corrected as shown below:

In column 8, line 29, change "and" to --said--.

Signed and Sealed this

*Twenty-eighth* Day of *July 1981*

[SEAL]

*Attest:*

GERALD J. MOSSINGHOFF

*Attesting Officer*

*Commissioner of Patents and Trademarks*